United States Patent [19]

Chown

[11] Patent Number: 4,932,096

[45] Date of Patent: Jun. 12, 1990

[54] SOAP PAD

[75] Inventor: Peter A. C. Chown, Norfolk, England

[73] Assignee: Irish Wire Products PLC, United Kingdom

[21] Appl. No.: 265,893

[22] Filed: Nov. 2, 1988

[30] Foreign Application Priority Data

Nov. 6, 1987 [GB] United Kingdom ..... 8723047

[51] Int. Cl.[5] ..... A47L 17/08

[52] U.S. Cl. ..... 15/244.3; 15/209 B; 15/209 C

[58] Field of Search ..... 15/244.1, 244.3, 244.4, 15/209 B, 209 C

[56] References Cited

U.S. PATENT DOCUMENTS

| | | | |
|---|---|---|---|
| 1,697,499 | 1/1929 | Field | 15/209 B |
| 2,107,636 | 2/1938 | Kingman | 15/209 B X |
| 2,139,175 | 12/1938 | Schick | 15/209 B X |
| 2,948,911 | 8/1960 | Steiner | 15/209 B |
| 3,406,420 | 10/1968 | Siemund | 15/209 B X |
| 3,629,896 | 12/1971 | Sirneck | 15/209 B X |
| 3,908,218 | 9/1975 | Oishi | 15/209 B |

*Primary Examiner*—Frankie L. Stinson

*Attorney, Agent, or Firm*—Roylance, Abrams, Berdo & Goodman

[57] ABSTRACT

A soap pad (2) comprising soap, sponge material (6), and wire wool (4) provided around the sponge material (6).

7 Claims, 1 Drawing Sheet

SOAP PAD

This invention relates to a soap pad.

Soap pads are well known and they are extensively used in kitchens for cleaning pots and pans. The known soap pads comprise wire wool impregnated with dried soap. The known soap pads tend to loose their soap quickly and they also sometimes prematurely crumple up, thereby reducing their active surface area and making them more difficult to hold.

It is an aim of the present invention to obviate or reduce the above mentioned disadvantages.

Accordingly, this invention provides a soap pad comprising in combination:

(i) a layer of sponge material which has a first face and a second face, and which is positioned in the centre of the soap pad;

(ii) a layer of wire wool which is composed of metal strands, and which is provided on the first face of the layer of sponge material;

(iii) a length of wire wool which is composed of metal strands, and which is wrapped several times around the layer of sponge material such that the length of wire wool passes over the first and the second faces of the layer of sponge material so as to trap the layer of wire wool which is provided on the first face of the layer of sponge material;

(iv) soap which is provided on at least one of the layer of the sponge material, the layer of wire wool, and the length of wire wool;

and the soap pad being such that the length of wire wool has its metal strands extending transversely to the metal strands in layer of the wire wool.

The sponge material will usually be a single piece of sponge material. More than one piece of sponge material may however be employed if desired.

The sponge material will usually be a synthetic sponge material but it may be a natural sponge material if desired. The synthetic sponge material will usually be a plastics sponge material. The plastics sponge material may be a polyurethane material, styrene or polypropylene. A presently preferred plastics material is neoprene.

The wire wool may be any type of known and currently used metal material. The wire wool is also sometimes called steel wool.

The soap may be provided on the wire wool and/or the sponge material. Usually, the soap will just be provided on the wire wool. The soap may be provided on the wire wool in the same manner as for known soap pads.

The soap may be a known soap pad soap. The soap pad soap will thus usually be employed in a dried condition as in existing known soap pads.

The soap will usually be a fatty acid soap. The fatty acid soap may include tallow.

Advantageously, the soap includes an anti-rusting agent. This helps to stop rusting of the wire wool. The anti-rusting agent may be that known as BHT.

Advangageously, the soap pad includes scraper means. The scraper means may be employed to help remove particularly stubborn pieces of dirt from pots, pans, other kitchen utensils and other surfaces as may be desired.

Preferably, the scraper means is provided in the middle of the soap pad such that in use it can form a hard scraping edge along one side of the soap pad.

The scraper means may be a strip of hard plastics material. The strip of hard plastics material may be employed in any desired widths such for example as ½ inch or 15 mm.

The strip of hard plastics material may be made from any desired and appropriate plastics material, for example nylon or polyvinyl chloride.

Embodiments of the invention will now be described solely by way of example and with reference to the accompanying drawings in which.

Figure 1:
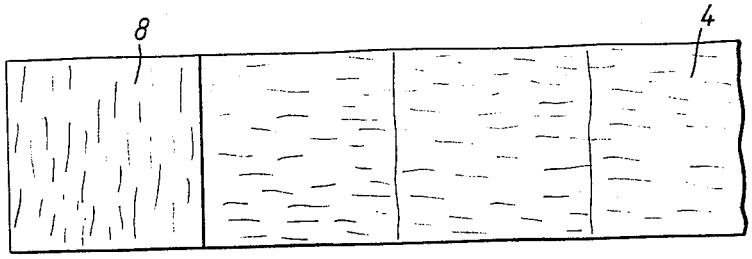
FIG. 1 is a plan view of a first soap pad in an opened out condition.
Figure 2:
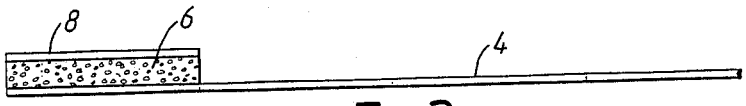
FIG. 2 is a front view of the soap pad as shown in FIG. 1.
Figure 3:
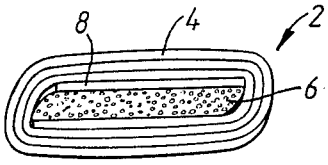
FIG. 3 is a front view of the soap pad as shown in FIGS. 1 and 2 but in a wound condition ready for use.

Referring to FIGS. 1 to 3, there is shown a soap pad 2 comprising soap which is provided on wire wool 4. The wire wool 4 is wrapped around a plastics sponge material 6.

As shown in FIG. 2, the sponge material 6 is laid on top of the wire wool 4. The wire wool 4 is composed of metal strands which extend longitudinally of the wire wool 4. On top of the sponge material 6 is a layer of wire wool 8. The wire wool 8 is composed of metal strands which extend transversely of the direction of the metal strands of the wire wool 4. The wire wool is then folded and wrapped around the sponge material 6 and the wire wool 8, as shown in FIG. 3.

The soap pad 2 is such that during use, the soap is retained for much longer than would be the case if the sponge material were omitted. For example, the soap pad 2 may retain its soap for as much as ten times as long as would be the case if the sponge material 6 were omitted. Furthermore, the soap pad 2 is easier to squeeze by virtue of the use of the sponge material 6. Also, the sponge material stops the wire wool 4 crumpling up too much, as often occurs with known soap pads without the sponge material 6. The soap pad 2 is generally easier to grip and has a more pleasant spongy feel than known soap pads without the sponge material 6.

The soap pad 2 may be produced by providing a reel of sponge material and then running across it a layer of the wire wool B. If desired, the wire wool B may be omitted. The wire wool is then wound around the sponge material 6. After the winding, the assembly is immersed in a hot molton soap bath. The assembly is then removed from the hot molton soap bath and squeezed between rollers to remove excess soap. The assembly is then passed to a drying area where the soap is dried. Thereafter, the assembly is cut to length to form the soap pads 2. The cutting may be effected by a swinging blade.

Figure 4:
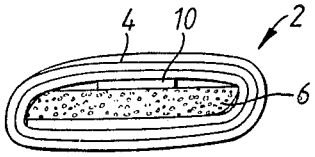
FIG. 4 is a front view of part of a second soap pad in a wound condition and ready for use.

Referring now to FIG. 3, there is shown a second soap pad 2 in which similar parts as in FIGS. 1 to 3 have been given the same reference numerals for ease of identification. In FIG. 4, the wire wool 8 has been omitted for ease of illustration. The soap pad 2 includes scraper means in the form of a strip 10 of hard plastics material. It will be seen that the strip 10 extends transversely of the longitudinal direction of the wire wool 6 so that the strip 10 forms a hard scraping edge along one open side of the soap pad 2. The strip 10 is made of a hard plastics material and it can be used for scraping away items of food and the like hat are otherwise difficult to remove.

It is to be appreciated that the embodiments of the invention described above with reference to the accompanying drawings have been given by way of example only and that modifications may be effected. Thus, for example, the sponge material could be in two or more layers or two or more pieces. Also, the sponge material 6 could be separately provided with soap if desired. The strip 10 can be employed in widths which are wider or narrower than illustrated in FIG. 4. Still further, another layer of the wire wool may be provided underneath the sponge material 6.

I claim:

1. A soap pad, comprising in combination:

(i) a layer of sponge material which has a first face and a second face, and which is positioned in the centre of the soap pad;

(ii) a layer of wire wool which is composed of metal strands, and which is provided on the first face of the layer of sponge material;

(iii) a length of wire wool which is composed of metal strands, and which is wrapped several times around the layer of sponge material such that the length of wire wool passes over the first and the second faces of the layer of sponge material so as to trap the layer of wire wool which is provided on the first face of the layer of sponge material;

(iv) soap which is provided on at least one of the layer of sponge material, the layer of wire wool, and the length of wire wool;

and the soap pad being such that the length of wire wool has its metal strands extending transversely to the metal strands in the layer of the wire wool.

2. A soap pad according to claim 1 in which the sponge material is a single piece of synthetic sponge material.

3. A soap pad according to claim 2 in which the single piece of synthetic sponge material is a single piece of neoprene.

4. A soap pad according to claim 3 in which the soap is provided just on the layer of the wire wool, and the length of the wire wool.

5. A soap pad according to claim 4 in which the soap includes an anti-rusting agent.

6. A soap pad according to claim 1 and including flat strip scraper means which is located at a centre part of the soap pad and which extends in the direction of the metal strands in the layer of wire wool so that a scraping edge of the flat strip scraper means is available for scraping and is not covered by turns of the length of wire wool caused by the length of wire wool being wrapped around the layer of sponge material.

7. A soap pad according to claim 6 in which the flat strip scraper means is made from a strip of hard plastics material.

* * * * *